US005255957A

United States Patent [19]

Opsvik et al.

[11] Patent Number: 5,255,957

[45] Date of Patent: Oct. 26, 1993

[54] ARRANGEMENT IN A CHAIR, FOR EXAMPLE A COMBINED CHAIR

[76] Inventors: Peter Opsvik, Hogtunveien 12, N-1370 Asker, Norway; Hans C. Mengshoel, P.O. Box 31-33, Oslo, Norway, 0207

[21] Appl. No.: 689,893

[22] PCT Filed: Dec. 12, 1989

[86] PCT No.: PCT/NO89/00130

§ 371 Date: Jun. 13, 1991

§ 102(e) Date: Jun. 13, 1991

[87] PCT Pub. No.: WO90/06704

PCT Pub. Date: Jun. 28, 1990

[51] Int. Cl.[5] ..... A47C 7/50

[52] U.S. Cl. ..... 297/423.12; 297/432

[58] Field of Search ..... 297/423, 428, 429, 431, 297/439

[56] References Cited

U.S. PATENT DOCUMENTS

| | | | |
|---|---|---|---|
| 1,067,914 | 7/1918 | Giasson . | |
| 2,524,187 | 10/1950 | Boles | 297/241 |
| 3,820,844 | 6/1974 | Fortnau | 297/432 |
| 4,767,159 | 8/1988 | Opsvik | 297/423 |
| 4,767,160 | 8/1988 | Mengshoel et al. | 297/423 |
| 4,832,407 | 5/1989 | Serber | 297/437 |
| 4,863,217 | 9/1989 | Fountain | 297/241 |

FOREIGN PATENT DOCUMENTS

| | | |
|---|---|---|
| 503634 | 7/1930 | Fed. Rep. of Germany . |
| 3808939 | 9/1988 | Fed. Rep. of Germany . |
| 844449 | 7/1984 | Norway . |
| 851435 | 4/1985 | Norway . |
| 342549 | 2/1972 | Sweden . |
| 2169502 | 7/1986 | United Kingdom . |
| 2171005 | 8/1986 | United Kingdom . |
| 2176396 | 12/1986 | United Kingdom . |

*Primary Examiner*—Peter R. Brown
*Attorney, Agent, or Firm*—Darby & Darby

[57] ABSTRACT

Arrangement in a chair (1), for example a combi-chair allowing for a plurality of sitting positions, in which in order to make it easier for the user (20) when sitting down on the chair, and presenting a larger variety of sitting positions for the user (20), there is suggested an arrangement (10) which comprises one or more support devices (13) which are adapted to the user (20) of the chair (1), and which by the user (20), for example by a simple movement of the foot, may be brought into or away from arbitrary positions in relation to the chair seat (2), such that the user (20) on the one hand with the different support devices in their positions of use is given the choice between a plurality of stable support positions, for example a kneeling-like sitting position having the shins resting on a calf support, a conventional sitting position with the feet resting on the floor, a backwardly slanting position with the feet resting on supporting devices, or an advanced rearwardly tilted position with the back calves resting on support devices, and such that, on the second hand, the support devices in a position beyond the entrance area of the seat allows the user (20) to sit down and rise without interference from said support devices.

9 Claims, 12 Drawing Sheets

1
2
3
20
21b
21a
111
112
112a
113
115
116
120
110
121a
121b
122a
122b
123a
123b 20
21a
123b
123a
122b
122a
121b
21b
121a
1
2
3
112
113
110
115
116
111
120
112a

Fig.17a.
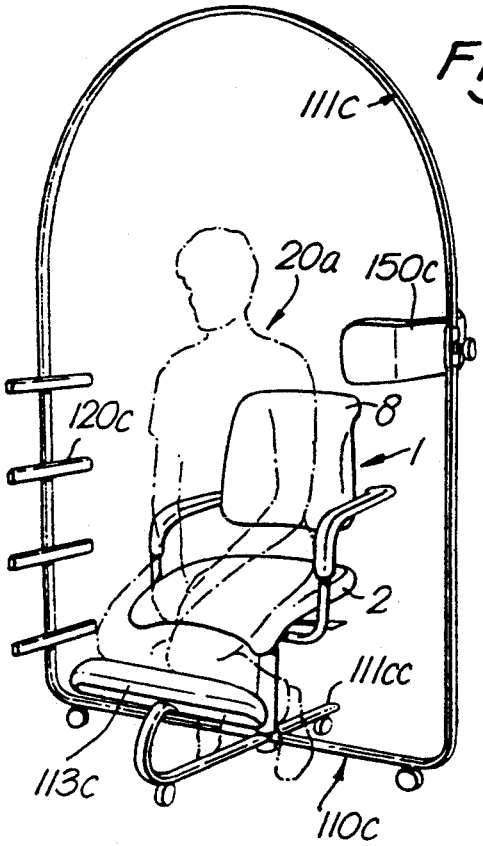
Fig.17b.
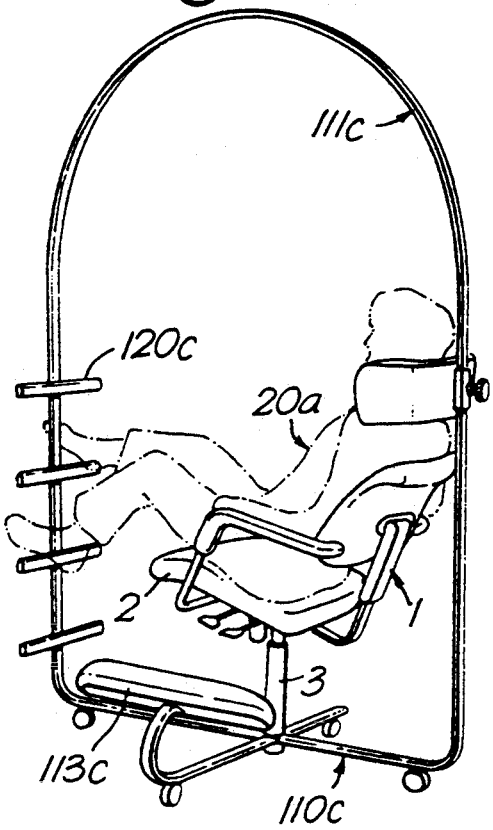
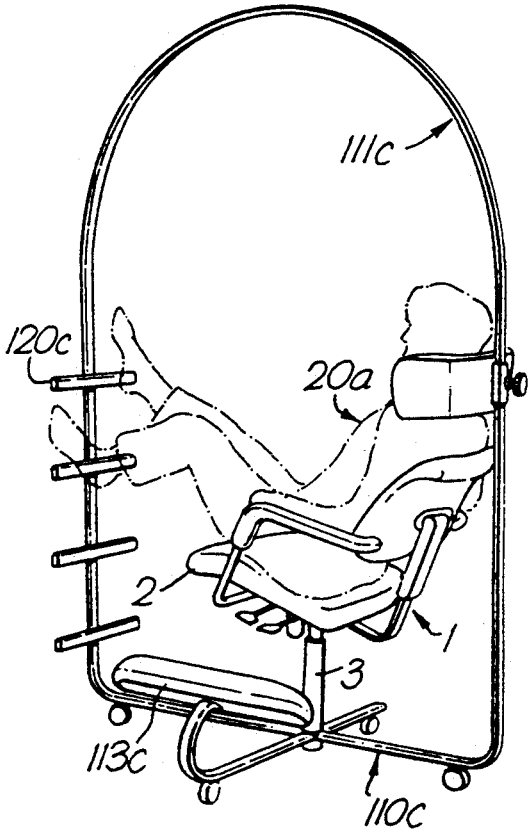
Fig.17c.

ARRANGEMENT IN A CHAIR, FOR EXAMPLE A COMBINED CHAIR

FIELD OF THE INVENTION

The present invention relates to an arrangement in a chair, for example a combi-chair allowing for a plurality of sitting positions. One example of such a combi-chair includes a chair allowing for a kneeling-like sitting position on an inclined forwardly tilting chair seat in which the shins of the user may rest on a shin support, as well as a usual chair sitting position on a substantially horizontal or rearwardly tilting chair seat in which the back of the user may rest against a back rest.

It is to be understood that the arrangement is not limited to the above described example of a combi-chair, since by the expression combi-chair it is to be understood all types of chairs giving possibilities of variation as regards sitting positions, for example "saddle chairs", on which the user may take "riding positions" in two, alternatively four different positions on the chair seat.

Further, the expression combi-chair should also comprise other types of sitting furniture allowing for various sitting positions, which includes forwardly tilting, rearwardly tilting, sidewardly tilting, completely or partly recumbent or more or less upright positions, in which the back, the chest, thighs, calfs, feet, head, neck or other body parts are completely or partly supported by appropriate supporting devices.

PRIOR ART

From NO patent application 85.0641 (GB 2.171.005) relating to a device to be used in a kneeling-like sitting position, there is known a solution for enabling a kneeling-like sitting position in connection with a chair as known per see, for example an office chair, without thereby having to buy a completely new chair for this purpose. In accordance with this prior art technique the solution suggests the provision of a supporting frame which preferably is detachably mounted on the frame of the chair or parts thereof, the supporting frame carrying at least one cushion which may support the user's knee or calf portion.

However, according to NO patent application 85.0641 only instructions are given to the fact that the supporting frame is to be attached around or to the centre column of the chair frame, which means instructions for clamping elements which will result in, if the chair is provided with a sub-frame, that said supporting frame will follow the movement of the sub-frame, i.e. constitute a so to say integrated part of said sub-frame. However, by such an integrated installation of the supporting frame and the sub-frame the user will not in any position of the seat be allowed a free access to, or freely be able to raise from the chair seat, without being obstructed by the supporting frame including its knee/calf supporting cushion. In other words, the user must swing himself and the body of the chair away from the supporting frame which is integrated in relation to the sub-frame, for thereby escaping from the area of said knee/calf supporting portion. If the user sits at a writing table and wishes no longer to use the knee/calf supporting device, she or he must first raise from the chair, whereafter the knee/shin portion together with the sub-frame must be swung away from the table, whereafter the user once more can take his place on the chair seat.

Likewise, a user who has swung himself 90° away from for example the working desk to for example a typewriter table, will leave the area of the knee/shin portion which remains in the same position as the sub-frame. If the user then will use the shin support at the typewriter table, the user must also here rise in order to turn the complete sub-frame of the chair together with the supporting frame for thereby bringing the knee/shin portion into the area of the seat portion, and when the user is to sit down, this will involve a "cumbersome" straddling over the knee/shin portion before the user can position his posterior on the chair seat.

Further, NO patent application 85.0641 only discloses a device which supports the knee/shin portion, which means that the user is limited either to use the chair as a "conventional" chair, or as a chair allowing for a kneeling-like sitting position, the shifting of the knee/shin supporting portion on the supporting frame involving a complecated and time consuming operation, whether the user chooses the one or the other sitting position.

From GB patent application 2.176.396 there is known a chair which also comprises a member extending from a part of the chair and carrying a supporting means for the feet of the user, but also here the extending member is provided so to say integrally with the chair part.

From NO patent application 86.3054 there is known an adjustable knee support for mounting onto a chair having a centre column, especially a hair dresser chair, the knee support not being contemplated for use by the person sitting in the chair, but by the hair dresser who mainly is positioned behind the costumer sitting in the chair, and who by use of the knee support will be able to relieve his body weight during the hair dressing work. The adjustable knee support according to NO patent application 86.3054 is thus developed so as to make it possible for the hair dresser to take a resting position with slightly bent knees abutting against the knee support when this position is considered appropriate, the hair dresser at the same time being able to move freely also closer towards the chair. In other words, the previously known rotatable knee support is only provided for rotating a certain angle behind the person sitting in the chair, such hair dresser chairs as a rule being provided with a permanent footstool onto which the user of the chair may put his feet. Consequently, such a prior art rotatable knee cushion will not resolve the above discussed problem, i.e. allow the user of the chair to have the knee support swung into the area of the chair seat for thereby enabling alternative sitting positions.

SUMMARY OF THE INVENTION

An object of the present invention is in connection with any type of chair which is to be classified as a combi-chair, i.e. chairs allowing for various sitting positions, and especially in connection with conventional office chairs having a chair body which can be tilted both forwardly and rearwardly, and more specifically for example a combi-chair allowing a kneeling-like sitting position on an inclined forwardly tilting chair seat wherein the shin or the shins may rest on a calf support, as well as a conventional chair sitting position including a substantially horizontal or rearwardly tilting chair seat wherein the user's back may rest against a back rest, to provide such a combi-chair which allows for further variations of sitting functions, the supporting means for such supporting devices adapted for the user of the chair enabling the bringing into function thereof and the bringing out of function thereof in a far more simpler manner of operation.

Today there are office chairs including conventional office chairs having a chair body which can be tilted both forwardly and rearwardly, and there also exist what is called kneeling-sitting devices comprising a forwardly tilting seat and a shin support which preferably tilts in the opposite direction.

Many users have a requirement for using such a kneeling-sitting chair during certain periods of the day or during specific types of work, i.e. it is a requirement to vary between a conventional office chair with a conventional sitting position and a chair in which the user may take a kneeling-like sitting position. The kneeling-like sitting position can be taken whenever anybody is to complete a jot wherein the body has to be bent forwardly, whereas the conventional office chair feels more comfortable when sitting in a conference or taking in the telephone and taking a rearwardly slanting position. On the basis of this requirement for varying sitting positions there are today provided chairs wherein these functions have been combined in one chair, for example as disclosed previously in connection with the discussion of NO patent application 85.0641, wherein two chairs have been combined into one, but wherein such a combination chair comprising seat, back and arm rests involves a cumbersome and time consuming handling of the shin support portion when this is obstructing the legs in the area of the front edge of the seat, especially when the user is to sit down or rise from the chair.

Further, experiments have been effected with a "conventional" office chair having a freely extending, rotatable frame supporting the shins in a kneeling-sitting position. However, such a frame will involve the danger for the user, when he takes the kneeling-like position, to have his point of gravity displaced so far out from the axis of balance of the chair, that the chair may easily tilt forwardly.

The object is achieved in an arrangement of the type as stated in the preamble, which according to the present invention is characterized in that the arrangement comprises a support device which is adapted to the user of the chair, and which the user can bring to any arbitrary position in relation to the seat portion, for thereby in a simple and effective manner to vary the means for the various sitting positions, and comprising stabilizing means which at least in a loaded condition of the support device takes a stabilizing position against the base of the chair.

In a practical embodiment of the arrangement according to the invention this may comprise at least one means which is pivotably mounted on a chair part and which carries the chair user supporting device for foot, shin, knees, etc of the user.

In other words, the present invention provides a combi-chair, wherein the necessary supporting devices for the individual sitting positions in a simple manner can be swung into and out of function for the user.

In connection with an office chair including a tiltable seat or a tiltable chair body which may function with all the usual advantages included in all office chairs, the user may if he so wishes, swing in a means carrying for example a shin support when the user wishes to take a kneeling-like sitting position in connection with a job in which the user body is tilted forwardly, and can then for example by his foot swing this shin support into the area of the seat portion for thereby utilizing the advantages in the kneeling-like sitting position.

When the user is to rise from the chair, she or he may for example by a simple movement of the foot swing the shin support out of the way, for thereby more easily to rise and possibly sit back again in relation to a free area in front of the seat portion.

When the user wishes to take a rearwardly tilted position, i.e. with a rearwardly tilting sitting angle, the user will feel that the front edge of the seat will rise and will then feel a requirement for putting his feet on a higher point than the floor, for example a table plate, a drawer, etc, but in connection with the arrangement according to the present invention the supporting arrangement thereof for foot, shins, knees, etc may in a simple manner be brought into the sitting area of the user for thereby being at the disposal thereof for the varying position which the user wishes to take in a rearwardly resting position. In other words, the arrangement according to the invention not only provides a supporting cushion for the calves, which can be used in connection with a kneeling-like position, but also provides instructions for how in a simple manner other supporting means can be brought into operation on the pivotable means, for example foot support for putting the shoes thereupon, footstools to put the thigh or the rear calf thereupon, such a chair user supporting device being provided with individual members or devices combining said functions and many more.

In other words, according to the present invention there is provided a means carrying a chair user support or chair user supports, said means in a first swung out position giving full access opening for the user to the chair seat, whereas the means in a second swung in position brings individual or combined supporting devices into the user area of the user when he or she rests on the chair seat, the user being able to control this swinging in and swinging away of the chair user supports whilst she or he all the time is sitting on the chair seat.

An appropriate embodiment of the arrangement includes a means which is provided freely rotatable in relation to a substantially horizontal chair column, said means being supported by castors at a portion which is provided at a distance from the chair column, or possibly said means with its distance portion in loaded condition touching the floor outside the radius of the crossed base and thus stabilizing the user position. The means may as previously discussed, carry a plurality of various foot, knee, calf or other supports for the user. By providing the means with several arms each arm may carry a chair user supporting device, possibly a combination thereof.

A combined chair user supporting device may in connection with a pivotable means include a means which as a starting point carries a chair user supporting device, which possibly comprices a length and/or height regulating mechanism, and which possibly includes a linked outer arm member possibly including a further link mechanism, for thereby allowing tilting of the supporting device, so that this, aside from being used for a kneeling-like sitting position, also can be used as a foot support and/or back calf support in the same manner as a footstool.

An embodiment for a pivotable means could be such that this carries a combination of a front calf or shin support and a foot support, the front calf support being provided closest to the chair column, whereas the footstool possibly comprises a plurality of foot support members provided at various levels on an upwardly extending portion of said means.

Said means may carry one or more foot supports alone, for example on an upwardly extending portion comprising transversely extending pairs of foot supports.

In order to adapt the arrangement to existing chairs, the various means may be adapted for releasable attachment to a chair member for simple installation thereon, for example as a separate unit which in a simple manner may be mounted afterwards on a chair having for example a tiltable seat, and for example by attachment means fitting the chair column at various heights thereof.

It is to be understood that the arrangement according to the invention not necessarily has to be limited to chair user supporting devices comprising foot supports, shin supports, knee supports, thigh supports, etc, but may also be contemplated used in connection with neck supports, back supports, arm supports, etc, where such features may be appropriate.

BRIEF DISCUSSION OF THE DRAWINGS

The invention will in the following be described further with reference to the appending drawings illustrating embodiments of the present invention.

Figure 2:
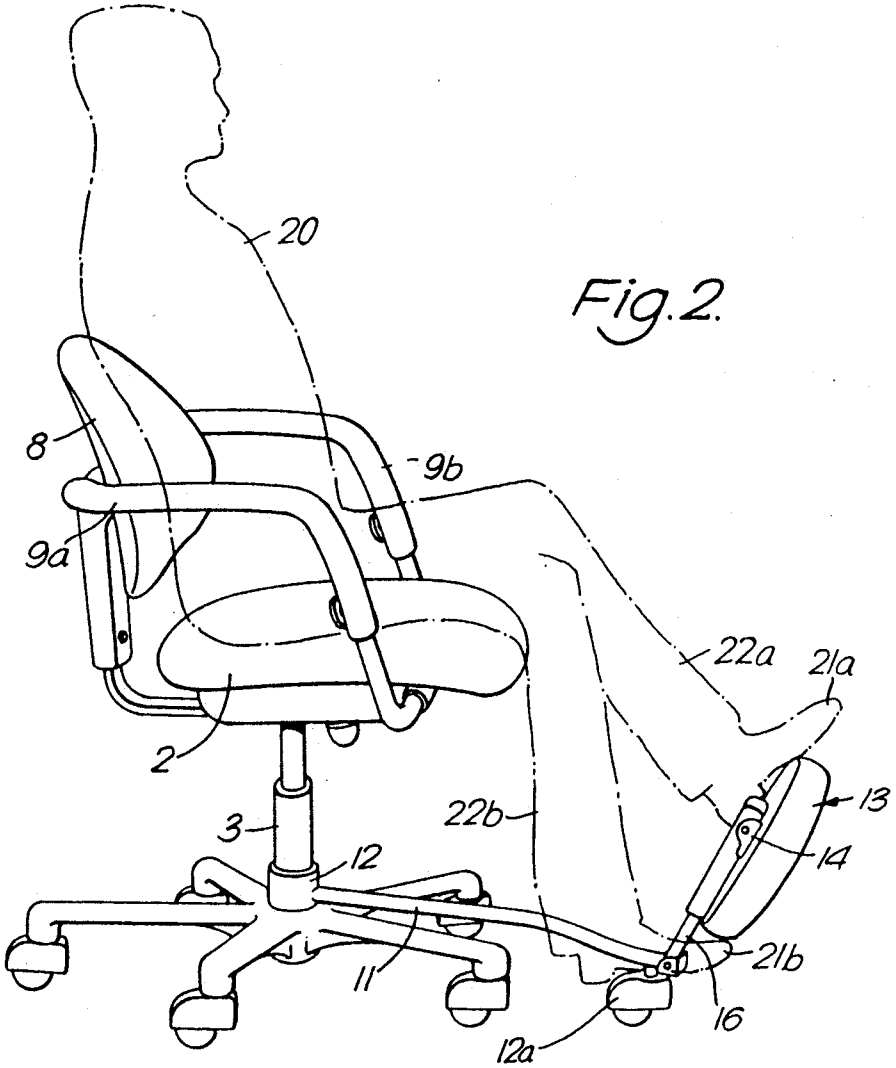
FIGS. 1–3 illustrate a first embodiment of an arrangement according to the invention, FIG. 1 illustrating the arrangement used in a kneeling-sitting position, FIG. 2 illustrating the arrangement used as a foot support and FIG. 3 illustrating the arrangement used as a back calf support or footstool.
Figure 1:
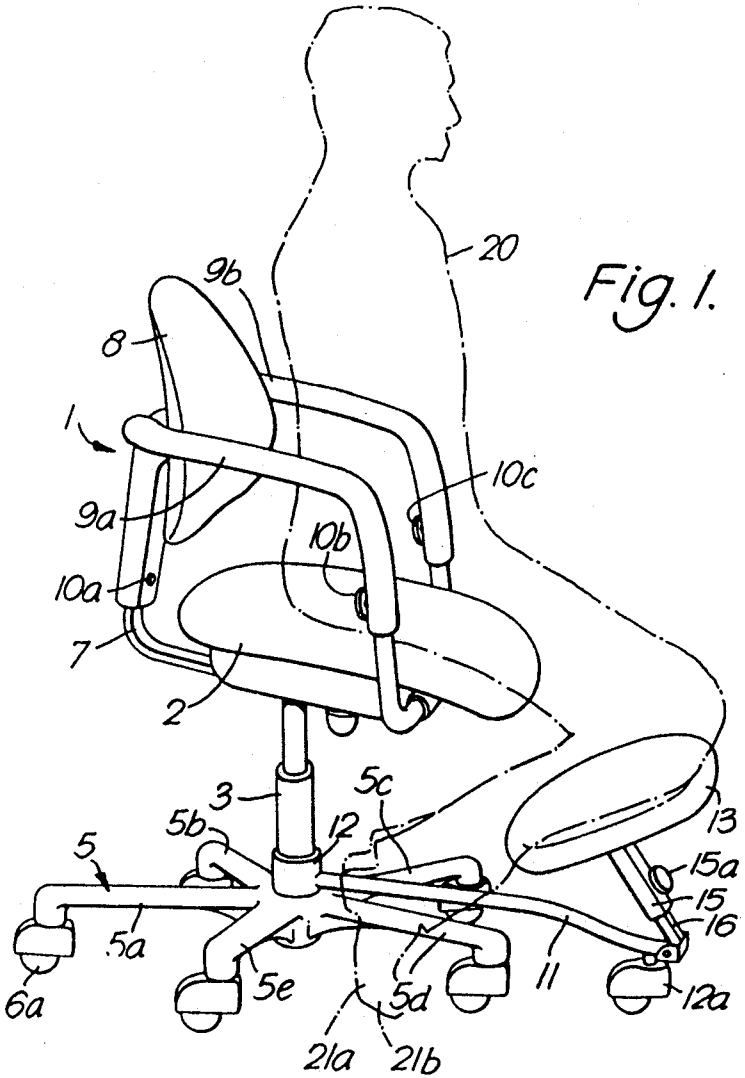
Figure 3:
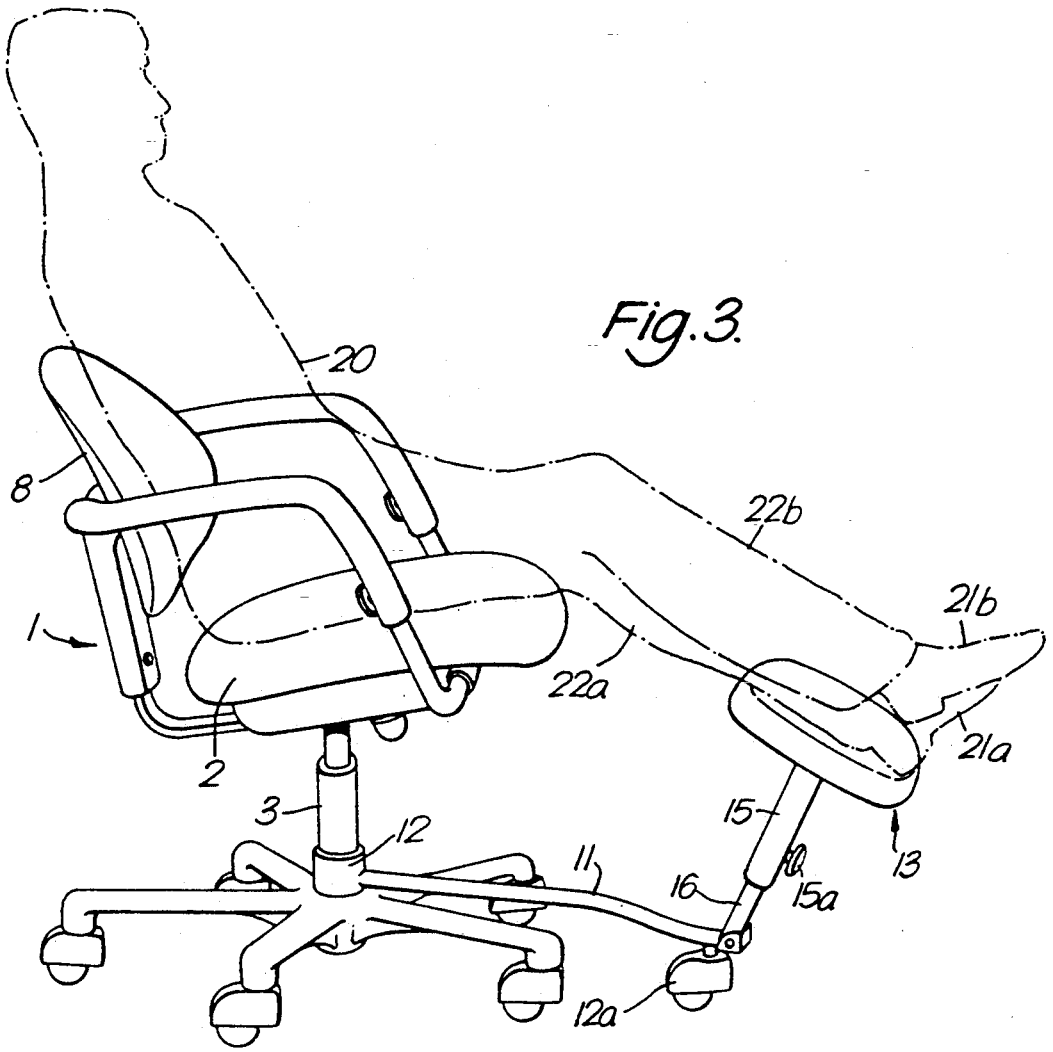

FIGS. 8*a*, 8*b*, 8*c* and 8*d* are perspective views of the device illustrated in FIGS. 1–3, as seen from various inclined angular views.

Figure 4:
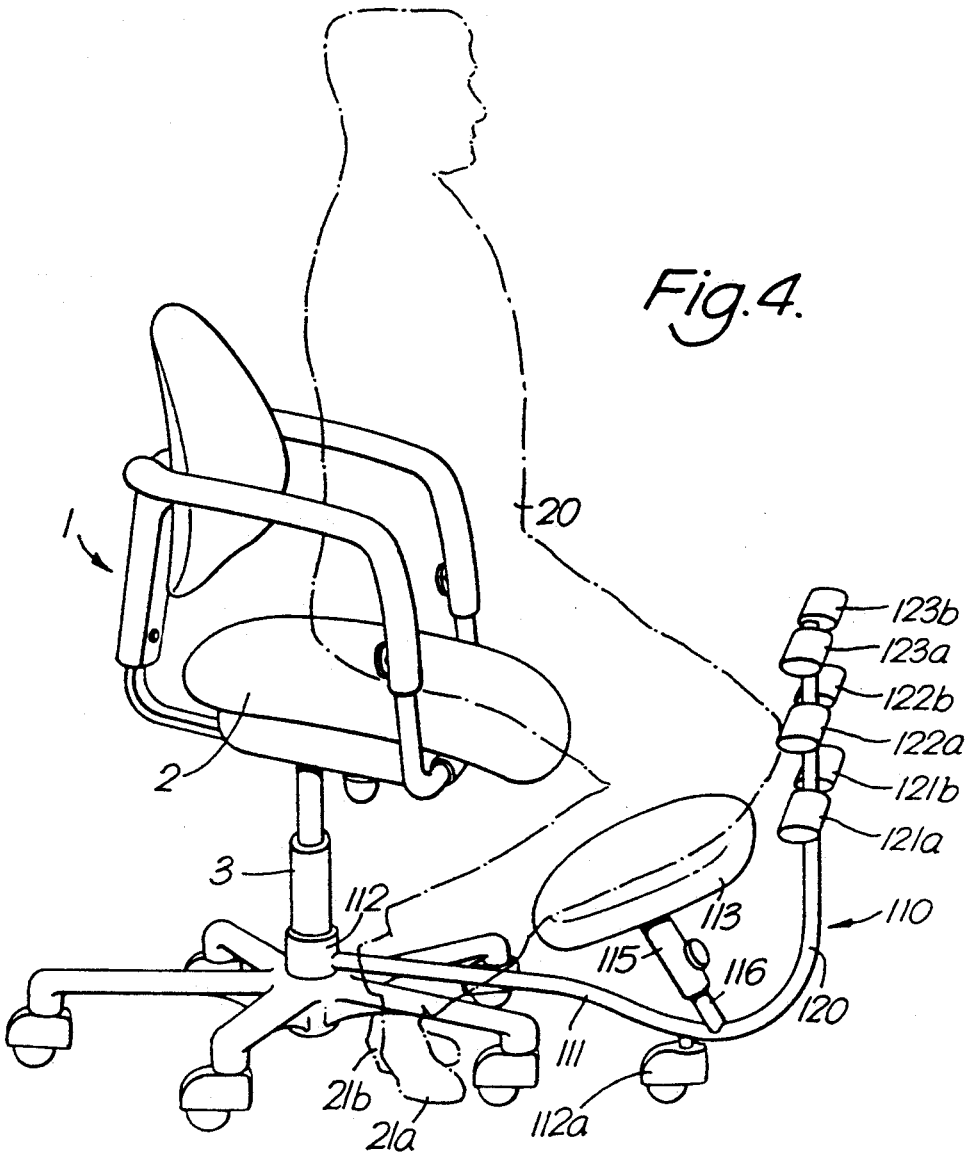
FIGS. 4 and 5 illustrate another embodiment of the arrangement according to the invention, wherein this is designed as a combination arrangement carrying various chair user supporting devices, FIG. 4 illustrating the arrangement used in connection with kneeling-sitting position and FIG. 5 illustrating the arrangement used as a foot support.
Figure 5:
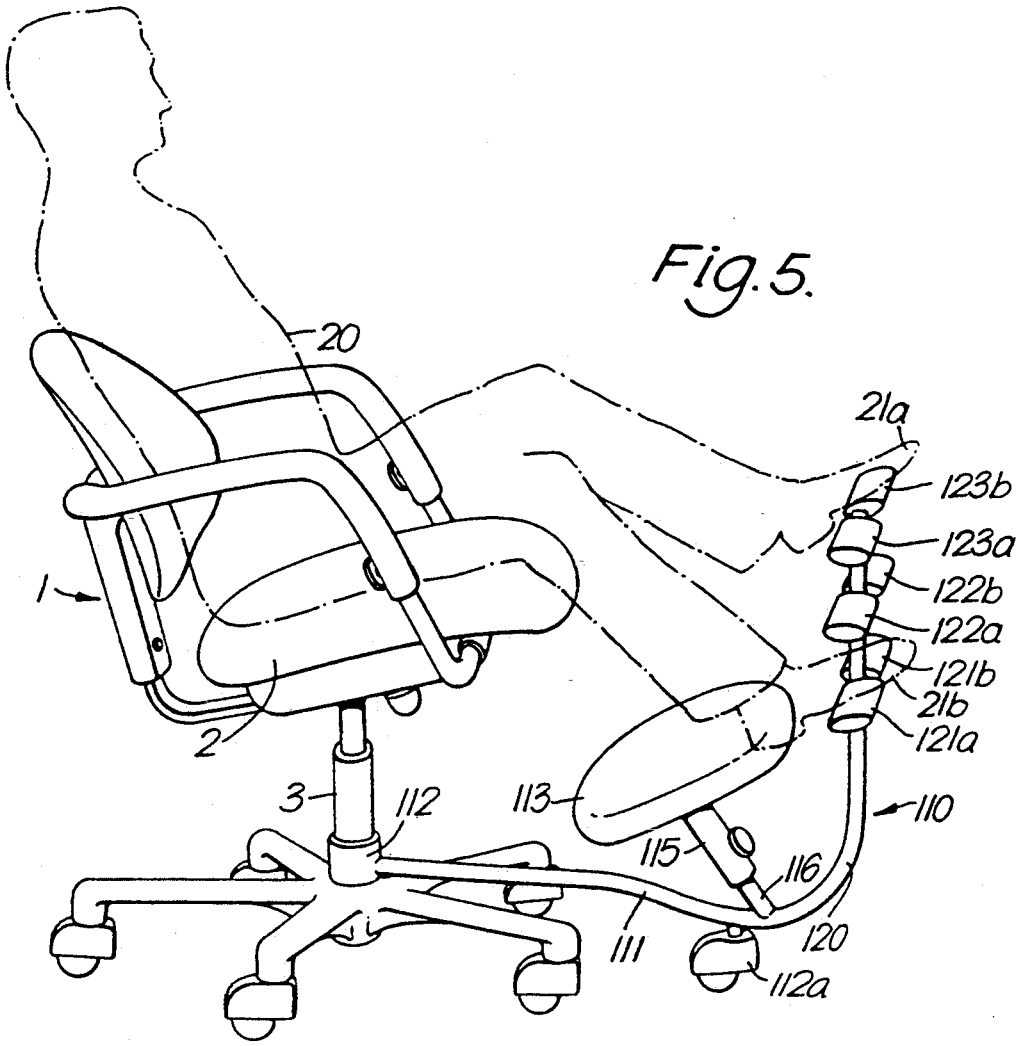
Figure 9A:
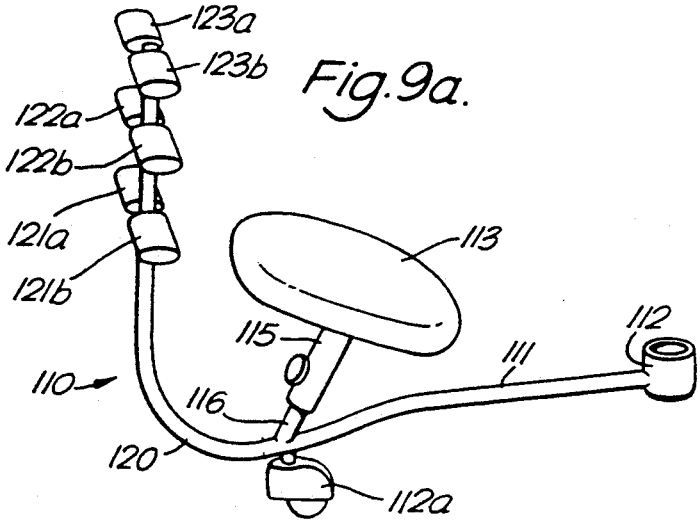
Figure 9B:
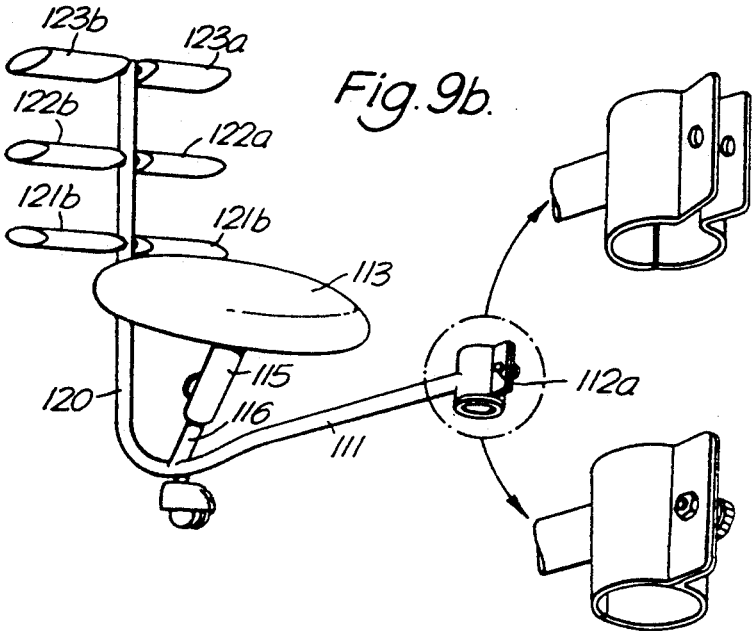

FIGS. 9*a* and 9*b* illustrate details of the arrangement according to FIGS. 4 and 5, as seen under various perspective views.

Figure 6:
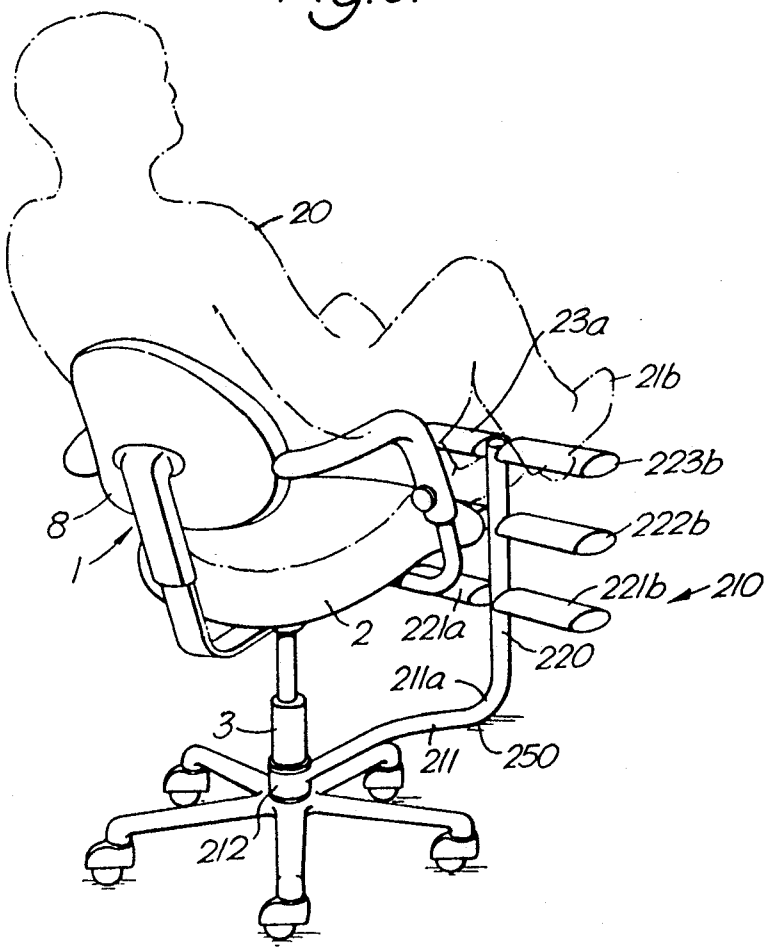
FIG. 6 illustrates a third embodiment of the arrangement according to the invention, here designed as a means including pairs of foot supports.
Figure 8A:
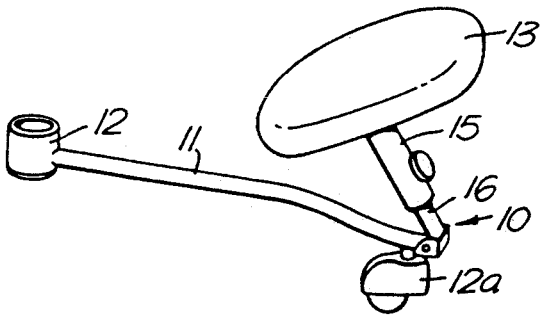
Figure 8B:
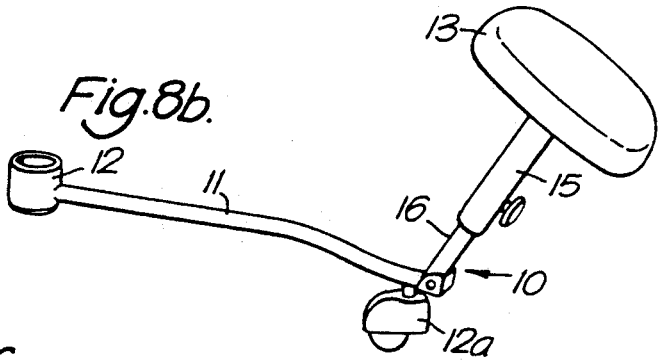
Figure 8C:
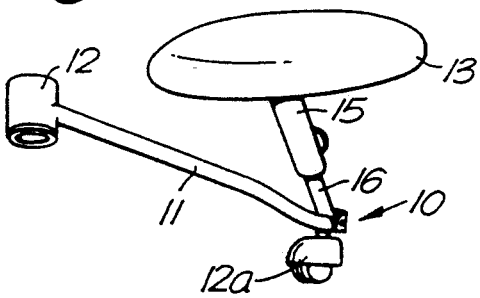
Figure 8D:
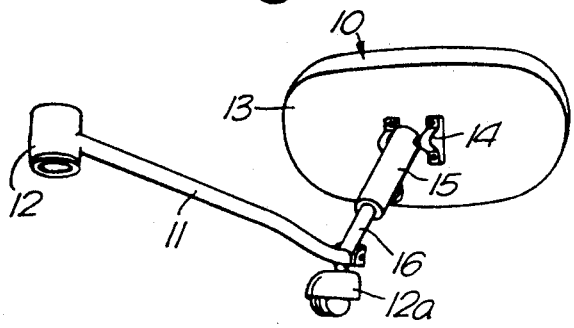
Figure 10A:
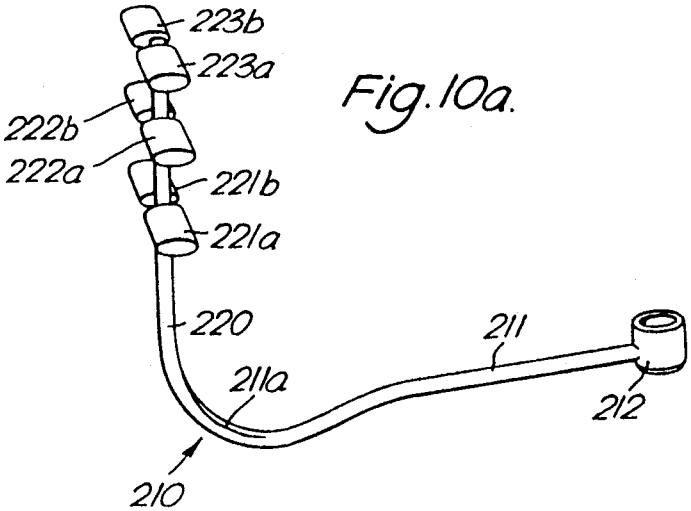
Figure 10B:
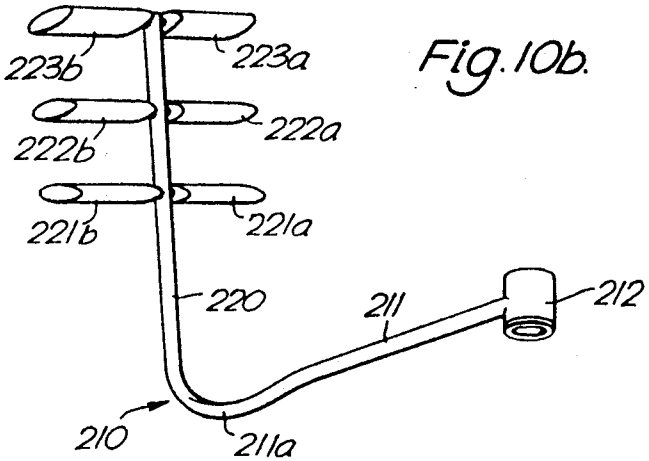

FIGS. 10*a* and 10*b* illustrate various perspective views of the arrangement illustrated in FIG. 6.

Figure 7:
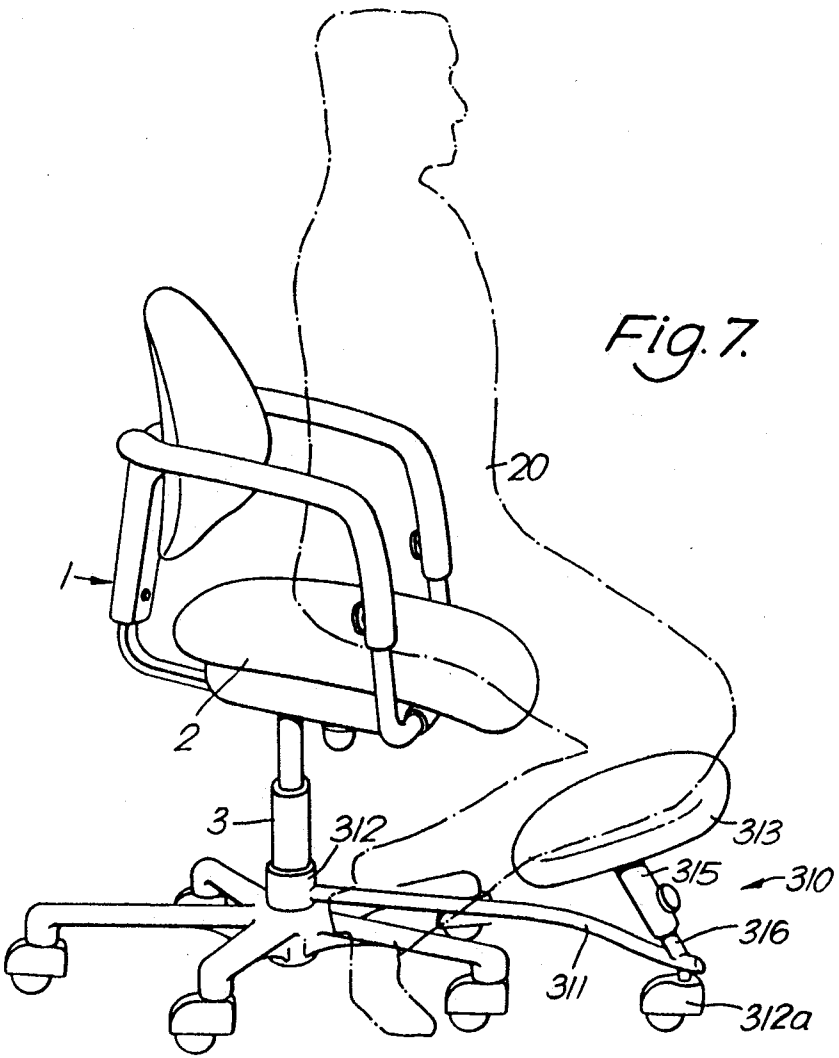
FIG. 7 illustrates a variant of the embodiment shown in FIGS. 1–3, said embodiment comprising fewer free options.
Figure 11A:
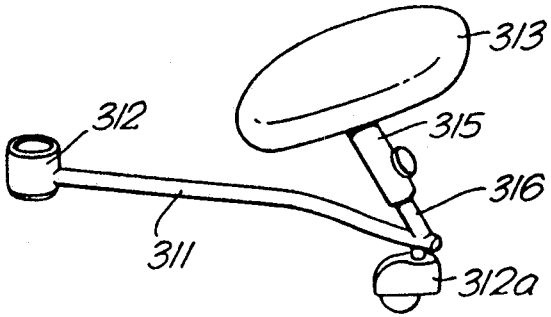
Figure 11B:
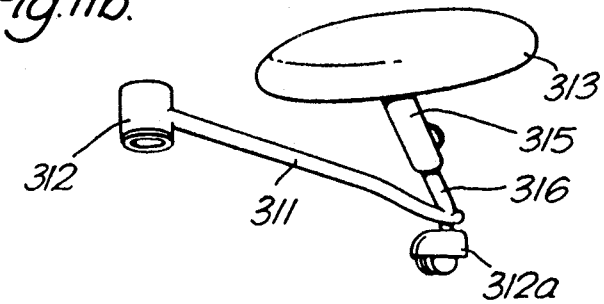

FIGS. 11*a* and 11*b* illustrate various perspective views of the arrangement illustrated in FIG. 7.

Figure 12:
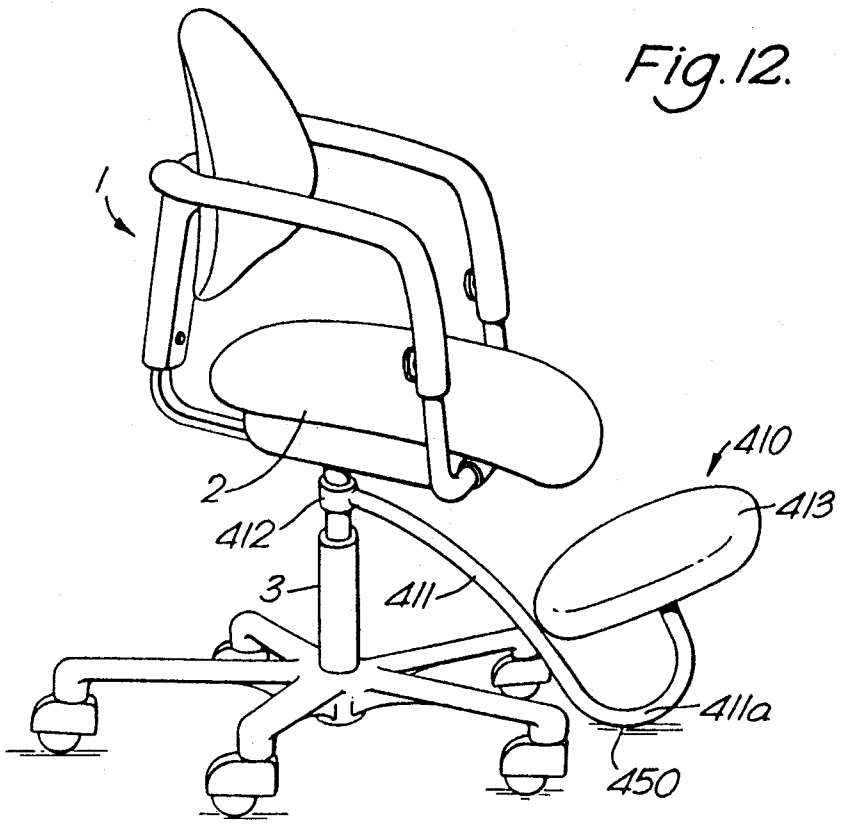

FIG. 12 illustrates a chair including a further variant of the arrangement according to the invention.

Figure 13:
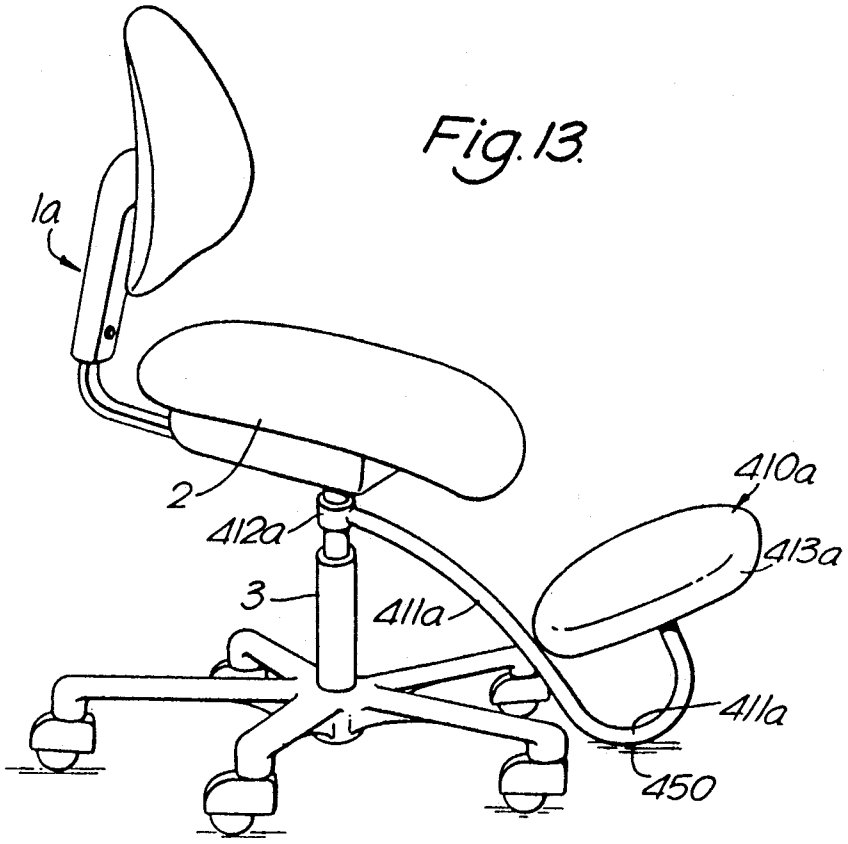

FIG. 13 illustrates a chair including yet another variant of the arrangement according to the invention.

Figure 14:
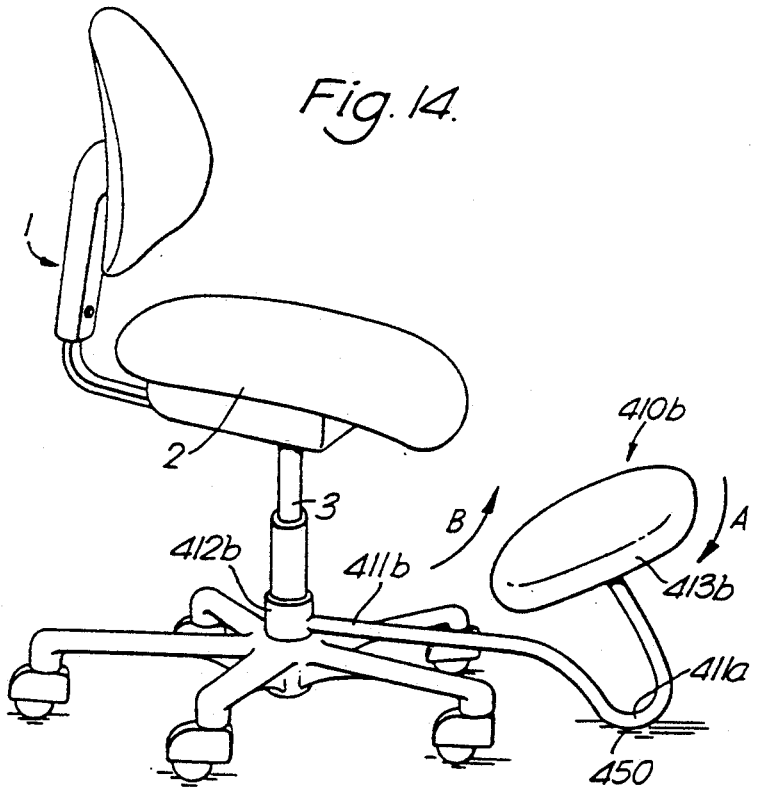

FIG. 14 illustrates a chair without arm rests, comprising still another variant of the arrangement according to the invention.

Figure 15:
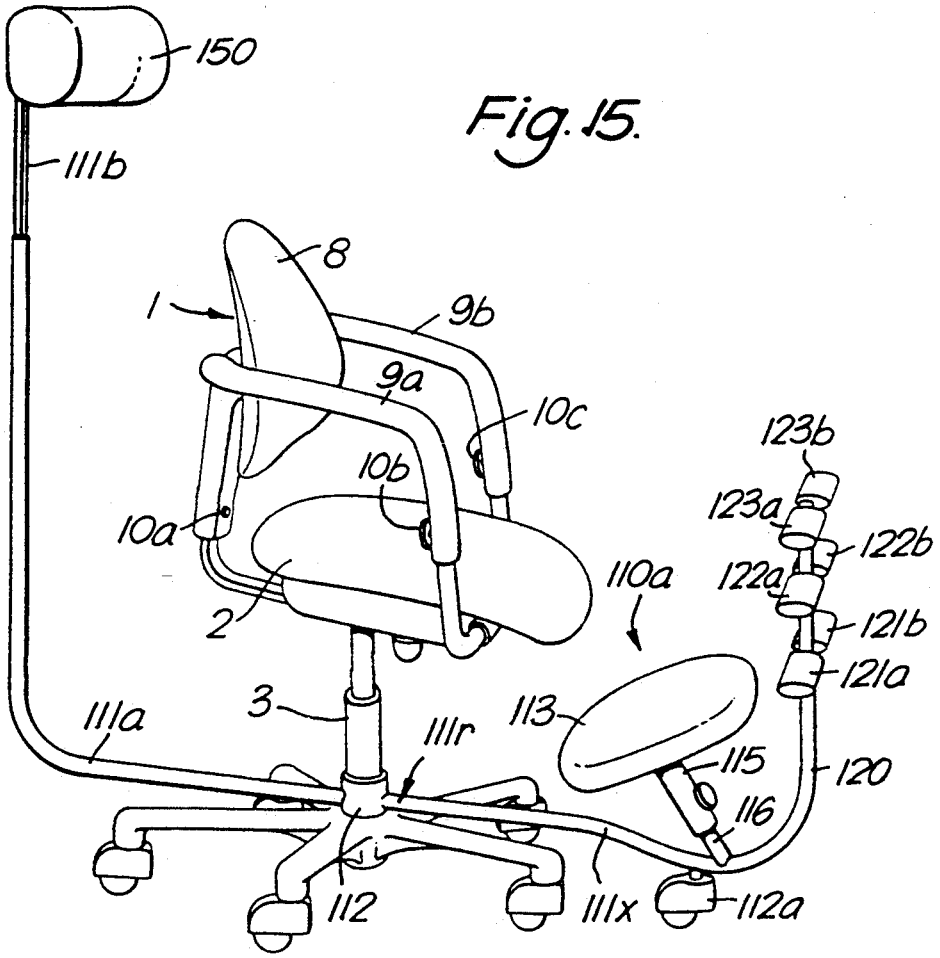

FIG. 15 illustrates a chair including a variant of the arrangement according to the invention, comprising a combination of neck, foot and calf support.

Figure 16:
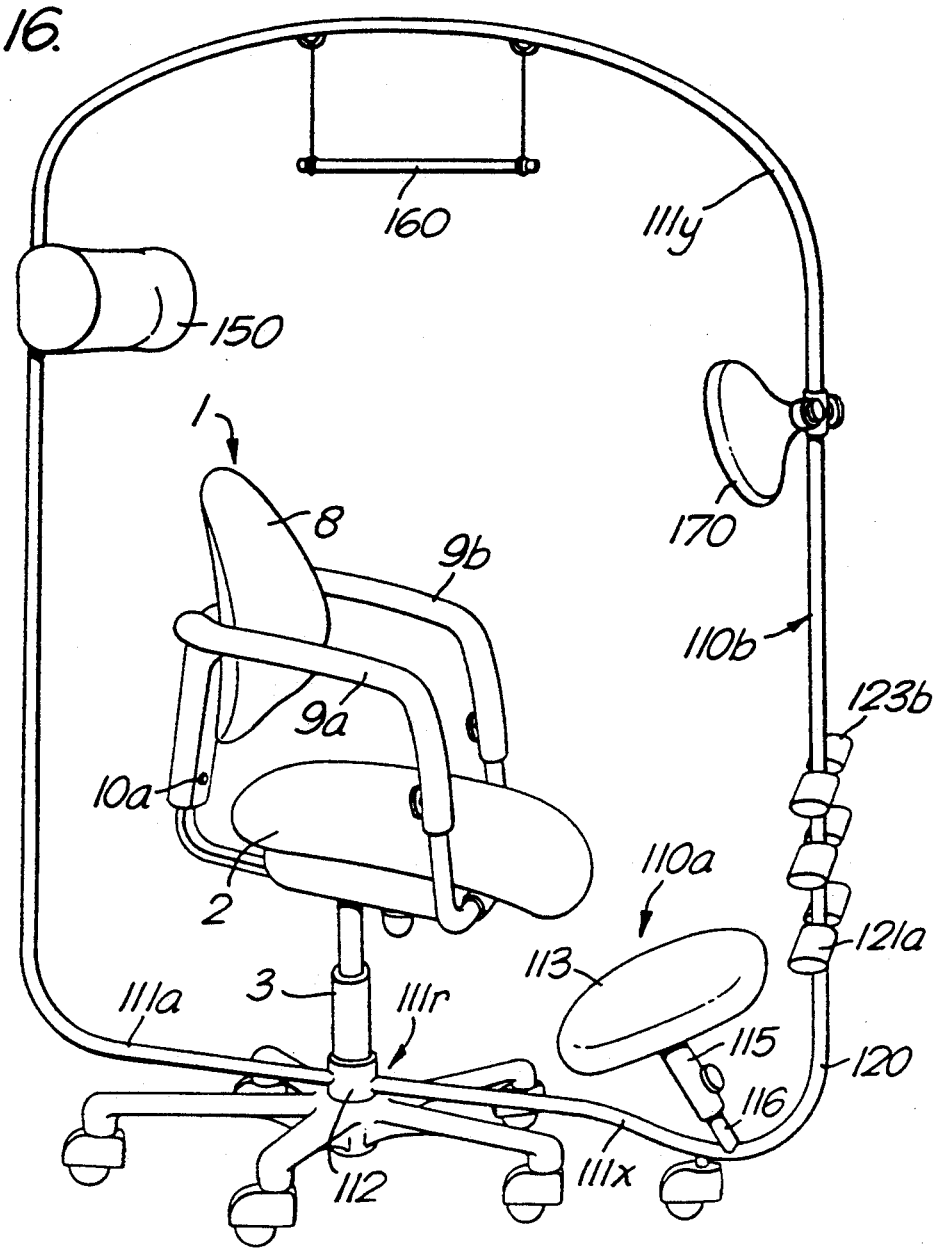

FIG. 16 illustrates a still further variant of the arrangement illustrated in FIG. 15.

FIGS. 17*a*, 17*b* and 17*c* illustrate yet another variant of the arrangement illustrated in FIG. 15.

DETAILED DESCRIPTION OF EMBODIMENTS

In FIGS. 1, 2 and 3 which illustrate a first embodiment of a chair in which the present invention has been implemented, the chair itself is generally designated by reference numeral 1. This may as such be of a known type, comprising a seat 2 which is carried by a horizontally extending column 3 with included height adjustment, said column 3 at the bottom being terminated in a branched crossed base 5, comprising five substantially equal arms 5*a*–5*e*, each or which at its free end being provided with a castor, 6*a*–6*e*, respectively, allowing the chair 1 to be rolled on a base.

The seat 2 of the chair may be of the tiltable type and attached thereto is provided a bent holding arm 7 carrying a back support 8 which in turn is provided with integral arm rests, 9*a* and 9*b*, respectively, all or which is provided with adjustment screws 10*a*, 10*b*, 10*c* for adjustable raising and lowering of the back support 8 together with the arm rests 9*a* and 9*b*.

According to the invention the chair 1 is provided with a supporting device, here generally designated by reference numeral 10, which in the embodiment illustrated in FIGS. 1–3 comprises a means 11 which at its one end is provided with a rotatable bearing 12 for pivotable installation on the centre column 3 of the chair 1. At its other end the means 11 is provided with a castor 12*a* supporting the means against the base, as well as a supporting device 13 which in the illustrated embodiment comprises a cushion which at its bottom side is provided with a link mechanism 14 merging into a sleeve 15 which in turn is threaded onto a linked arm 16 at the front end of the means 11, namely in the area of the castor 12*a*.

The illustrated device which in the FIGS. 1–3 is generally designated by reference numeral 10, is by its rotatable installation on the centre column 3 so adapted that a user, here designated by reference numeral 20, can bring the supporting device 13, here designed as a cushion, to and from the area of the seat 2. In other words, the user may according to his own wish, bring the supporting device into action in the area of the seat, and then in an easy and power reducing manner.

In FIG. 1 the supporting device 13 is tilted to such a position that the user 20, when she or he has brought the seat 2 to a forwardly tilting slanted position, can use the supporting device or the cushion 13 to take a kneeling-like position. If the user 20 wishes to rise from the chair, then the person 20 may with a simple movement of the foot swing the device 10 out of the area of the seat 2, and thereby easily be able to leave the chair, which is also the case if the user wishes to once again sit down on the chair seat 2. In FIG. 2 the user has adjusted the seat 2 to a rearwardly tilting position, and at the same time the supporting device 13 has been "double tilted" forwardly in a direction away from the user, i.e. the linked arm 16 has been tilted to a forwardly extending slanted position, and the cushion 13 has via the link mechanism 14 been tilted to an inclined upwardly extending position. With this backwardly tilting position of the seat 2 and with the position of the supporting device 13 illustrated in FIG. 2, the user 20 may support his feet, 21*a* and 21*b*, respectively, on the forwardly tilted supporting device 13, which will aid in giving the user 20 a comfortable, rearwardly slanting sitting position, in which the back is resting against the back support 8, and wherein the thighs may be somewhat raised from the front edge of the chair seat 2.

In FIG. 3 the user 20 has taken a still further rearwardly tilted position compared with FIG. 2, the chair seat 2 here together with the back support 8 being designed such that there is allowed for a resilient tilting movement, or a rocking movement depending on the user's movements and his point of gravity. In the form of use illustrated in FIG. 3, as regards the supporting device 13, the cushion is here illustrated in a slanting forwardly directed position, and the linked arm 16 including its sleeve 15 takes the same forwardly directed slanted position as in FIG. 2. However, the cushion 13 will in case of the form of use according to FIG. 3, provide support for the back calf of the user, 22*a* and 22*b*, respectively, which means that the chair 1 together with the supporting device 13 now can be used as an easy chair with a footstool.

Also in case of the form of use illustrated in FIGS. 2 and 3 the user 20 may with a simple movement of his foot be able to swing the device 10 out of the area of the seat, for thereby achieving a free area in front of the seat 2, such that the user easily may leave or take a position on the seat. Besides, it is to be understood that the sleeve 15 can be displaced telescopically on the linked arm 16, there being provided a tightening screw 15*a* which may affix the sleeve 15 at various heights, which is favourable for the user if the hight adjustment may contribute to more comfortable and/or varied sitting positions.

Possibly, the means 11 may be provided with length adjustment mechanisms (not illustrated), which might be appropriate for adjustment in relation to various user sizes, possibly for displacing the device 10 forth and back to a parking position underneath the chair seat.

The device 10 in accordance with FIGS. 1-3 gives instructions for how a conventional office chair 1 with tilting seat 2 in a very simple and inexpensive way may be converted to a multi-combi-chair, which allows for a plurality of sitting positions, here for example four sitting positions.

The first sitting position illustrated in FIG. 1 allows for a kneeling-like sitting position with inclined forwardly tilting chair seat 2 wherein the shins of the user may rest on the shin supporting cushion 13.

A second position may be a usual chair sitting position with a forwardly tilting, substantially horizontal or rearwardly tilting chair seat, wherein the back of the user is more or less supported against the back support 8, and wherein the device 10 is swung out of the area of the seat 2, which is not illustrated in said Figures.

A third position which the user may take, as this is illustrated in FIG. 2, is a usual chair sitting position with a substantially rearwardly tilting chair seat, wherein the user supports his feet on the pivotable device 10.

In the forth position the user can take the position illustrated in FIG. 3, i.e. a rearwardly inclined or rearwardly tilting "chair-stool"-position, wherein the legs 22*a*, 22*b* rest on a stool-like device 10.

In FIGS. 4 and 5 there is illustrated a second embodiment of the device according to the invention, here generally designated by the reference numeral 110, this device being adapted to a chair which is generally designated by 1, and which may comprise the same details as the chair illustrated in connection with FIGS. 1-3. The arrangement 110 in FIG. 4 comprises also here a means 111 which at its inner end is provided with a rotation bearing 112, adapted for pivotable installation on the centre column 3 of the chair 1. At its front end the means 111 is provided with a castor 112*a* and in this area the means 111 carries a first support device 113, substantially of the same design as the support device 13 in FIGS. 1-3, but here preferably provided with a sleeve 115 which is displaceably mounted on an arm 116 which is welded to the means 111.

In addition to the first support device 113 the brackett 111 carries an upwardly extending second arm 120 carrying a plurality of foot support pairs, 121*a* and 121*b*, 122*a* and 122*b*, 123*a* and 123*b*, respectively.

In FIG. 4 the user 20 has taken a kneeling-like sitting position, in which the shins of the user are supported by the first support device 113, the chair seat 2 here preferably taking a forwardly directed tilted position.

In FIG. 5 the user 20 has tilted the chair seat 2 to a rearwardly slanting position, and the user has also lifted his feet from the first support device 113 and put his feet 21*a*, 21*b* on foot supports appropriately suited therefore, it being noted that said foot supports may be pivotably provided for thereby more easily to follow the user's foot position or foot movements. It is to be understood that due to the pivotable mounting of the combined arrangement 110 illustrated in FIGS. 4 and 5 this may of course in a simple and power reducing manner be swung out of the area of the chair seat 2, which gives the user not only more possibilities for varying sitting positions, but also a simpler possibility for sitting down on the chair seat and alternatively rise therefrom, since the swung away arrangement then opens the area in front of the chair seat.

In FIG. 6 there is illustrated a third embodiment of the arrangement according to the invention, here generally designated by reference numeral 210, this arrangement also comprising a means 211 which at its one end is provided with a pivotable bearing 212 for pivotable installation on the centre column 3 of the chair 1, the means 211 at its other end merging into an upwardly extending arm 220 via a stabilizing portion 211*a*, which here is not supported by any castor, but which when not in use allows free rotation of the means 211, but which when in loaded condition will touch the floor 250 outside the radius of the crossed base. The arm 220 carries a plurality of foot support pairs 221*a* and 221*b*, 222*a* and 222*b*, 223*a* and 223*b*. The sitting position which is here taken by the user 20, is the same as discussed in connection with FIG. 5, and when the arrangement 220 is not intended for use, and when it is unloaded, it may of course with a simple movement of the foot be swung sideways out of the area of the front portion of the chair seat 2.

In FIG. 7 there is illustrated a variant of the embodiment according to FIGS. 1-3, the arrangement here which is generally designated by reference numeral 310, still comprising a means 311 including a pivotable bearing 312 which is provided pivotably on the centre column 3 of the chair 1, the support device 313 comprising a cushion which is carried by a sleeve 315 on an arm 316. The arm 316 is here rigidly connected with the means 311, which may also be the case for the connection between the sleeve 315 and the shin support or cushion 313. This means that the chair according to FIG. 7 defines a combi-chair, wherein the user 20 shifts substantially between a kneeling-like sitting position as illustrated in FIG. 7, and a conventional chair sitting position having a substantially horizontal or rearwardly tilting chair seat, wherein the support device 313 may be in a swung in or swung out position in relation to the seat 2.

In FIG. 7 there is also illustrated a castor 312*a* which rests against the floor, and which has the function of preventing the user 20 to tilt forwardly when being in a kneeling-sitting position. The position of the castor is beyond the radius of the crossed base, and the user 20 will as illustrated in FIG. 7, sit safely in his kneeling-sitting position.

It is to be understood that the support device 313 may also, as a variant, be provided without castor 312*a*, and then only as an outwardly extending somewhat flexible arm, which via a stabilizing portion which in uninfluenced position sweeps just above the level of the floor, merges into the upwardly extending arm 316. In influenced position, i.e. as illustrated in FIG. 7, and with the user 20 in a kneeling-sitting position, said stabilizing portion will rest against the floor and stabilize the chair 1.

In FIGS. 8*a*–8*d* there are illustrated further details in an arrangement as discussed in connection with FIGS. 1–3, the same reference numerals here being used for the same parts and portions, and FIGS. 8*a*–8*d* illustrating how the arrangement 10 may be designed as a separate unit which with simple expedience may be rotatably installed on the carrying column of a chair.

In FIGS. 9*a* and 9*b* there are perspectively illustrated views of the combi-arrangement 110 which is discussed in detail in FIGS. 4 and 5, the arrangement 110 also here being provided as a separate unit which by simple expedience may be mounted on a conventional chair, for example an office chair with a tiltable seat. The pivotable bearing 112 illustrated in FIG. 9*a*, may for example have a clamping function as illustrated by 112*a* in FIG. 9*b*.

In FIGS. 10*a* and 10*b* there are illustrated perspectively various details of the embodiment of the arrangement 210 discussed in detail in FIG. 6, the arrangement also here being designed for expedient mounting on the carrying column of a chair.

In FIGS. 11*a* and 11*b* there are illustrated perspective views of the arrangement 310 discussed in detail in connection with FIG. 7.

In FIG. 12 there is illustrated a chair 1 which is similar to those previously discussed, the chair 1 here being provided with a variant of the combi-arrangement 410, which is here attached to the upper portion of the carrying column 3 of the chair, the arrangement 310 here comprising a relatively small means 411, comprising a pivotable bearing 412 provided at the one end, and provided with a support device, here for example in the form of a calf support 413 which is carried by the freely extending portion of the means 411. Also here the means 411 is provided with a stabilizing portion 411*a*, which may rest onto the floor 450. It is to be understood that the calf support 413 may by provided with members allowing for adjustment of the calf support in relation to the location on the means 411, as well as allowing for various inclined positions depending on the desire felt by the user. This variant of a shin support 413 excels in having a light and space saving design, which means that it not only can be easily pushed aside or pushed into the area of the front of the chair seat 2, but also prevent any bulky appearance in relation to the other dimensions of the chair. If the means 411 is provided with length adjustment this may be used for bringing the calf support underneath the area of the seat 2. In FIG. 13 there is illustrated an arrangement 410 which is similar to that illustrated in FIG. 12, this variant being provided on a chair 1*a* of a similar type as the chair 1 in FIG. 12, but with the exception that the chair is here not provided with arm rests.

In FIG. 14 there is illustrated a further variant of a combi-arrangement 410*b* including a means 411*b* which with its pivotable bearing 412*b* is attached in the area at the bottom of the support column 3 of the chair 1, the means 411*b* comprising a stabilizing portion 411*a* and carrying a calf cushion 413*b* which in a slanting position of the seat 2 can be used for a kneeling-like sitting position by the user.

The means 411*b* can with a simple movement of the foot of the sitting user be swung into the area of the front of the seat 2 in the direction of the arrow A, whereas it, for example in the direction of the arrow B, can be swung out of the area of the front portion of the seat. Besides, the pivotable bearing 412*b* may be provided with a not illustrated blocking screw which contributes to the possible locking of the arrangement 410*b* in any arbitrary angular position around the carrying column 3 of the chair.

It is to be understood that the present invention is not limited to the above described embodiments, but that other variants of the arrangement carrying the support devices may be contemplated.

For example, it is possible not only to provide support devices which the user can bring into and away from the area of the seat portion, such that the user by various leg, foot or thigh positions may vary his sitting positions, but also provide support devices coming into effect together with other parts of the body, for example neck, shoulder, arm portions, etc., for thus rendering further possibilities for movement or possibilities for sitting by the person using the combi-chair in accordance with the present invention.

It is to be understood that the pivotable arrangement may be provided with a portion which in turn may adopt various means for the support of the user's feet, shins, knees, thighs, neck, shoulders, etc., all in dependence of which sitting position the user wants to take. Further, it is to be understood that the present, preferably pivotable arrangement may be implemented not only as one means, but also by two means, preferably extending from each side of the chair column, but provided for rotation about the latter. By such a two-armed frame one of the arms may carry a foot support, whereas the second arm may carry a neck support, or a combination thereof or of other support devices.

In FIG. 15 there is illustrated an example of an arrangement 110*a* according to the invention, comprising such a two-armed frame or means 111*r*, which in many aspects is founded on the embodiment of the arrangement 110 discussed in connection with FIGS. 4 and 5.

In the embodiment according to FIG. 15 the means 111*r* carries on a first arm 111*x* a first calf supporting device 113 and a second support device 120 taking the form of an arm having a plurality of foot support pairs 120*a*–123*b*, and on a second arm 111*a* a third support device 150 designed substantially as a neck support. The neck support 150 takes the form of a support cushion of an appropriate soft material and is via a possibly adjustable arm 111*b* attached to the arm 111*a* which at its bottom merges the pivotable bearing 112 on substantially the opposite side of the means 1114 carrying the arm 115 with the calf support device 113 and the arm 120 with the foot support 121*a*–123*b*.

The chair seat 2 is also here arranged tiltable, and when a user tilts himself rearwardly to a resting position and rests his feet against appropriate foot supports 121a–123b, for example as illustrated in FIG. 5, the user will feel a need for some form of a neck support. Since the neck support 150 is located diagonally opposite of the foot support 120, the user may combined the sitting position which is illustrated for example in FIG. 5, with that of resting his neck or head against the head/neck support 150. In the illustrated embodiment the neck support 150 may be adjusted up or down for adaption to the neck or head of the user, and when the user tilts the chair seat 2 back to "sitting"-position or working position in front of a desk, the neck support 150 will be out of the way since it remains on the arm 111a independent of the tilting position of the seat.

The diametrical opposite mounting of the neck support 150 and the foot support 120 will bring forth that the user when taking a conventional working position in front of a writing desk may have the arrangement 110a swung out of the area in front of the seat 2, for example 90 angular degrees sideways. When for example the telephone rings the user may swing the seat approximately 90 angular degrees in order to "register" the arrangement, and then make use of both the foot support and the neck support. The user may then in connection with his various work operations be able to take varying forwardly tilting and rearwardly tilting sitting positions. Consequently, the user achieves, in relation to conventional combi-chairs, further variants as regards sitting functions, which aid in stimulating the bodily functions of the user when utilizing the chair, the latter also in this case deserving the designation multi-combi-chair, or multi-function-chair.

In FIG. 16 there is illustrated still another variant of the arrangement which is discussed in connection with FIG. 15, the arrangement 110b comprising substantially the same support devices as described in connection with FIG. 15, but wherein the diagonally opposite arms 111a and 111x of the means or the frame 111r are extended beyond the area of the neck support 150 and beyond the area of the foot support 120, respectively, for merging into a common arc-shaped arm portion 111y.

The user of the chair 1 may as described in connection with FIG. 15, also here perform the same functions, but in addition the described arm portion 111y may be provided with further equipment or auxiliary means which the user may take advantages of in connection with the work or activity which is to be exercised in the area of the chair.

In FIG. 16 there is at the top of the arm portion 111y illustrated some form of a trapeze 160 which the user in some positions of the chair 1 may reach with his arms, and by means of the trapeze may make appropriate stretching movements of the upper part of the body, possibly use the trapeze 160 for thereby helping himself up to a risen position if this should be necessary or desired.

In FIG. 16 there is also illustrated an apparatus 170 which may be displaceably attached to the arrangement 110b, for example at a position opposite the neck support 150, which means that the user in his "neck support" position of the chair 1 may watch the apparatus 170, which for example may comprise one or another form of screen including two-way communication, for example in connection with a television telephone. However, it is to be understood that the apparatus 170 may also be a transmission apparatus for not only information communicating waves, but also waves for stimulation, recreation and/or entertainment.

In FIGS. 17a, 17b, 17c there is illustrated an embodiment of an arrangement according to the invention, which may be designated as yet another variation of the arrangement illustrated in FIG. 15, or the arrangement as illustrated in FIG. 16, the arrangement 110c in the FIGS. 17a–17c also here comprising a calf support 113c, a foot support 120c as well as a neck support 150c.

Differently from the arrangement according to FIG. 16 the calf support 113c is mounted 90 angular degrees displaced in relation to both the foot support 120c and the neck support 150c, said two last mentioned supports, i.e. the foot support 120c and the neck support 150c being provided diagonally opposite on a gateway-shaped frame 111c which consequently is mounted 90 angular degrees displaced in relation to the frame 111cc carrying the calf support 113c.

It is to be understood that the arrangement 110c illustrated in FIGS. 17a, 17b and 17c may be provided pivotably in relation to the centre column 3 of the chair, namely by providing the centre column 3 with further castors, for example of the type as discussed in connection with FIG. 1, but which for the sake of survey is deleted in FIGS. 17a–17c.

Further, it is to be understood that the frame 111c carrying the neck support 150c and the foot support 120c, may be provided pivotably in relation to the frame 111cc carrying the calf support 113c, such that the user 20a according to his which may swing the various frames into the desired use area of the chair 1 itself.

FIGS. 17a, 17b and 17c illustrate how not only the arrangement 110c shown on said Figures may be utilized by the user 20a, but also how the arrangement 110a discussed in connection with FIG. 16 may be utilized in a corresponding manner.

FIG. 17a illustrates the user 20 in a kneeling-like sitting position, which may be appropriate in front of a writing desk or similar, it being understood that the chair itself including the seat 2 may be tilted back to a position which is preferred when the user 20a wishes to rest the back against the back support 8.

In FIG. 17b the user 20a has swung the chair 1 90 angular degrees in relation to the position shown in FIG. 17a, and will in this position take advantages of the foot support 120c and the neck support 150c. In FIG. 17c the user 20a takes approximately the same position as shown in FIG. 17b, but uses here a foot support pair of the foot support 120c provided at a higher level.

It is to be understood that the arrangement 110c illustrated in FIGS. 17a–17c may, of course, be completed with the devices 160 and 170 illustrated in FIG. 16, as well as with other devices or auxiliary means which may be required, and which will contribute to various sitting positions reducing the possibility of stress ailments.

Further, it may be contemplated other embodiments, wherein three means are used on the arrangement, these means being angularly displaced for example 120°, and each means carrying various members for the support of different body portions of the user, all or which should be adapted to various sitting positions and seat positions.

Since all of the arrangements are provided such that the user may bring them to and from arbitrary positions in relation to the area of the seat portion, the various support devices may suitably be put side, or be put into use position, such that the user may bring one or more of the respective support devices away from his sitting field or the user field of the chair, and then in dependence of which sitting position the user wants to take.

Further, it is to be understood that by making the present arrangement adjustable both in hight and in length, as well as providing the same with link and/or telescope connections, possibly also including appropriate hook-on mechanisms there may be achieved a very great variety of support devices and the positioning thereof.

We claim:

1. A chair comprising:

a support column;

a chair seat having a back support connected thereto;

means coupling said chair seat to said support column to permit the chair seat to be tilted forward from a normal substantially level sitting position to one with the seat downwardly inclined;

link means rotatably mounted on said support column;

an elongated carrier means having one end connected to said link means;

support means at the other end of said carrier means for supporting a part of the leg of the person sitting in the chair seat;

means for pivotally mounting said support means to said carrier means to permit it to pivot from a use position to support the shin of the user in a kneeling-like position when the chair seat is in its forwardly inclined position and to support the foot or rear calf of the user with the chair seat in it s normal position, and at a position spaced away from said chair seat to give access to the chair seat; and stabilizing means mounted to said carrier means for engaging a surface to prevent the chair from tilting when the support means is loaded.

2. A chair for resting on a surface comprising:

a chair seat having front and rear edges, and a back support, a supporting column having upper and lower ends, chair seat mounting means for mounting said chair seat to said column support upper end, said chair seat mounting means permitting of said chair seat about said supporting column upper end first kneeling-like sitting position in which the chair seat tilted with its front edge below its rear edge and a second position in which said front and rear edges are substantially level to permit the user's back to rest against the seat back, a chair base on which the lower end of said column is mounted, an elongated carrying means having one end rotatably coupled to said column support, a support device mounted to the other end of said carrying means below said chair seat to support one or more parts of the user's leg, said support device being pivotable relative to said carrying means between a use position to support the shin of the user in a kneeling-like position when the chair seat is in its first position and to support the foot or rear calf of the user with the chair seat in its second position, and a position spaced away from said chair seat to give access to the chair seat, and stabilizing means mounted to said carrying means for engaging the surface to prevent the chair from tilting when the user loads the support device.

3. A chair as claimed in claim 2 wherein the chair seat is freely rotatable in relation to said support column.

4. A chair as in claim 2 wherein said stabilizing means comprises a rotatable means.

5. A chair as in claim 2 wherein said carrying means comprises a beam extending from said support column and outwardly of said chair seat and base, said support device being at the end of said beam.

6. A chair as in claim 5 wherein said stabilizing means comprises a castor at the end of said beam carrying said support device.

7. A chair for resting on a base while allowing for a plurality of sitting positions, comprising:

a column having an upper end and a lower end, the base being mounted on the column lower end and resting on a surface, a chair seat mounted to the column upper end, a support device for the user of the chair which can be brought to any arbitrary position in relation to the seat, such support device including:

an outer arm portion extending in front of said chair seat and having one end pivotally mounted to said column, a chair user support for the foot, shin and rear calf of the user mounted on said outer arm portion, tilt means for allowing the tilting of the chair user support for alternate use as a shin support, foot support, rear calf support, or footstool, and a stabilizing means coupled to said outer arm portion which in a loaded condition of the support device takes a stabilizing position against the surface.

8. A chair as in claim 7 further comprising means for adjusting the height of said outer arm portion relative to said column.

9. A chair as in claim 7 further comprising means for adjusting the length of said outer arm portion.

* * * * *